US006901841B2

(12) United States Patent
Holland

(10) Patent No.: US 6,901,841 B2
(45) Date of Patent: Jun. 7, 2005

(54) GAS BLEED SYSTEM WITH IMPROVED CONTROL

(75) Inventor: Christopher D. Holland, Wood River, IL (US)

(73) Assignee: Lincoln Industrial Corporation, St. Louis, MO (US)

( * ) Notice: Subject to any disclaimer, the term of this patent is extended or adjusted under 35 U.S.C. 154(b) by 18 days.

(21) Appl. No.: 10/630,288

(22) Filed: Jul. 30, 2003

(65) Prior Publication Data

US 2005/0022660 A1 Feb. 3, 2005

(51) Int. Cl.[7] ..... F01B 25/06
(52) U.S. Cl. ..... 91/221; 91/406
(58) Field of Search ..... 91/220, 221, 406, 91/451; 137/120, 121, 122, 126, 175; 138/43, 46

(56) References Cited

U.S. PATENT DOCUMENTS

| | | | | |
|---|---|---|---|---|
| 956,287 | A | | 4/1910 | Champ |
| 967,963 | A | | 8/1910 | Onsrud |
| 977,486 | A | | 12/1910 | Thompson |
| 1,957,490 | A | | 5/1934 | Davis |
| 1,958,503 | A | | 5/1934 | Wintzer |
| 2,023,771 | A | | 12/1935 | Ringius |
| 2,201,248 | A | | 5/1940 | Stone |
| 2,224,463 | A | | 12/1940 | Wineman |
| 2,630,758 | A | | 3/1953 | Henkel |
| 2,765,804 | A | | 10/1956 | Dinkelkamp |
| 2,898,005 | A | | 8/1959 | Rotter |
| 3,816,025 | A | | 6/1974 | O'Neill |
| 4,181,066 | A | | 1/1980 | Kitchen et al. |
| 4,333,827 | A | | 6/1982 | Cummins, II |
| 4,462,759 | A | | 7/1984 | McGeehee |
| 4,846,045 | A | | 7/1989 | Grach et al. |
| 4,889,472 | A | | 12/1989 | Decker et al. |
| 5,349,895 | A | * | 9/1994 | DiCarlo ..... 91/221 |

FOREIGN PATENT DOCUMENTS

| | | |
|---|---|---|
| GB | 1 344 623 | 1/1974 |

* cited by examiner

*Primary Examiner*—Thomas E. Lazo
(74) *Attorney, Agent, or Firm*—Senniger Powers

(57) ABSTRACT

A bleed system for venting pressurized gas at a selectively adjustable flow rate. The bleed system includes a plurality of bleed flow paths of different lengths providing varying resistance to the flow of air and a bleed path selector mechanism movable between a plurality of different settings corresponding with the different flow paths. The flow paths are defined by channels formed in a face of a plate and are connectable in series. The bleed system is applied in a runaway control for an air motor which shuts off the motor when its speed exceeds a predetermined cut-off speed. Selection of a different bleed flow path adjusts the cut-off speed.

22 Claims, 9 Drawing Sheets

GAS BLEED SYSTEM WITH IMPROVED CONTROL

BACKGROUND OF THE INVENTION

This invention relates to control of gas flows, and more particularly to a bleed system for releasing pressurized gas from a chamber at a selectively adjustable flow rate. The bleed system is described primarily herein for application in a runaway control for an air motor which shuts off the motor when its speed exceeds a predetermined threshold speed. However, it is understood that the bleed system may be applied in any device where pressurized gas is released at a controlled rate.

It is difficult to accurately control a release of gas from a higher pressure region to a lower pressure region, particularly for an adjustable, low-level release. Due to manufacturing tolerances, conventional bleed valves frequently exhibit inconsistent or varying sizes of flow passages. Adjustments which are intended to produce minor incremental changes in flow rates can result in large step changes. Consequently, the valves are over-sensitive, cannot be accurately calibrated, and are not repeatable in setting a selected rate of flow.

A runaway control of the prior art is disclosed in U.S. Pat. No. 5,349,895, entitled "Air Motor Control," which is hereby incorporated by reference. That patent discloses an air motor with an expansible chamber having a reciprocable piston driving a pump for pumping materials such as lubricants, sealants, or inks. A problem of pump runaway is at times encountered, due for example to breakage of a discharge line or running out of the material being pumped. The load on the motor is reduced such that the motor speeds up and drives the pump at very high speeds. That can damage the pump and cause expensive and time-consuming spills of material. A runaway control is provided for cutting off operation of the air motor under these circumstances. The control can be adjusted so that it activates to cut off the air motor at a selectable and predetermined threshold speed (e.g., between 5 and 50 cycles per minute) which depends generally on the viscosity of the material being pumped. Adjustment of cut-off speed is effected by a bleed valve for adjusting the rate of flow from a chamber having a pressure which varies in proportion to the speed of the motor. The bleed may be adjusted to vent a maximum quantity of air from the chamber when operating the motor at an increased speed, or adjusted to vent a minimal quantity of air when operating the motor at a nominal speed.

A drawback to runaway controls is that bleed valves are prone to be over-sensitive to adjustments, as described above. It is difficult to accurately calibrate the bleed valve to obtain a desired cut-off speed or to repeat previously obtained settings.

SUMMARY OF THE INVENTION

Among the several objects and features of the present invention may be noted the provision of a gas bleed system for releasing gas at a selectively adjustable flow rate; the provision of such a system which may be calibrated to obtain repeatable flow rates; the provision of such a system for use in a runaway control of an air motor for stopping the motor if it should start to run away; and the provision of such a system which is efficient and durable in use and cost-efficient to construct.

In general, the present invention involves an improved air motor of the expansible chamber type comprising an air cylinder, a piston reciprocable therein, a valve mechanism shiftable alternately to effect supply of air to and venting of air from opposite sides of the piston to reciprocate the piston, and a runaway control operable on increase in speed of the air motor above a speed limit to stop the motor. The control includes a pressure-responsive mechanism comprising an air chamber for air under pressure, a movable mechanism movable away from a first position in response to increase in air pressure in the chamber above a predetermined pressure limit to a second position, and movable back to the first position on reduction of pressure in the chamber below the pressure limit. The movable mechanism when in its first position enables operation of the air motor and when in its second position cuts off operation of the motor. An air pump is interconnected with the motor for operation simultaneously with the motor for delivering air under pressure to the chamber at a rate related to the speed of the motor. The improvement comprises a bleed mechanism for bleeding air from the chamber at a controlled rate. The pressure in the chamber is controlled by the rate of delivery of air under pressure to the chamber and the bleed of air from the chamber. On increase in speed of the motor above the speed limit, the pump, operating at increased speed, delivers air under pressure at an increased rate to the chamber over and above the capability of the bleed to bleed off the increase, and on ensuing increase in air pressure in the chamber above the pressure limit, the movable mechanism moves to its second position to cut off the motor. The bleed mechanism comprises a plurality of bleed flow paths of different lengths providing varying resistance to the flow of air. Each bleed flow path has an inlet communicating with the chamber and an outlet. A bleed path selector mechanism is movable between a plurality of different settings corresponding to the plurality of different flow paths. The bleed path selector mechanism communicates in each of the settings with the outlet of one of the bleed flow paths and allows the bleed flow path to vent for bleeding air from the chamber while sealing the outlets of the other bleed flow paths, whereby the speed limit at which motor cuts off can be adjusted by moving the selector mechanism to the desired setting.

In another aspect, a bleed system according to the present invention vents pressurized gas from a chamber to a vent opening at a selectively adjustable flow rate to control change of pressure in the chamber. The bleed system comprises at least two passageways each adapted for venting gas from the chamber and thereby tending to reduce gas pressure in the chamber, each of said at least two passageways having a length. A selector mechanism is adapted for establishing fluid communication between the chamber and vent opening via a selected one of the passageways such that gas is vented from the chamber through the selected passageway to the vent opening. The passageways have different lengths such that selection of one passageway results in flow of gas from the chamber to the vent opening at one flow rate and selection of the other passageway results in flow of gas from the chamber to the vent opening at a different flow rate.

In yet another aspect, a runaway motor control system according to the present invention is for an air motor. The control system comprises a pressure-responsive mechanism operable on increase in speed of the air motor above a speed limit to stop the motor. The mechanism comprises an air chamber for air under pressure, a movable mechanism movable away from a first position in response to increase in air pressure in the chamber above a predetermined pressure limit to a second position, and movable back to the first position on reduction of pressure in the chamber below the pressure limit. The movable mechanism when in its first position enables operation of the air motor and when in its second position cuts off the operation of the motor. An air pump is interconnected with the motor for operation simultaneously with the motor for delivering air under pressure to the chamber at a rate related to the speed of the motor. A bleed mechanism is for bleeding air from the chamber at a controlled rate. The pressure in the chamber is controlled by the rate of delivery of air under pressure to the chamber and the bleed of air from the chamber, whereby on increase in speed of the motor above the speed limit, the pump, operating at increased speed, delivers air under pressure at an increased rate to the chamber over and above the capability of the bleed to bleed off the increase. On ensuing increase in air pressure in the chamber above the pressure limit, the movable mechanism moves to its second position to cut off the motor. The bleed mechanism comprises a plate having a series of channels in a face thereof providing bleed flow paths of varying resistance to the flow of air.

In one more aspect, a bleed system of the invention vents pressurized gas from a chamber to a vent opening at a selectively adjustable flow rate to control change of pressure in the chamber. The bleed system comprises a passageway establishing fluid communication between the chamber and vent opening for venting gas from the chamber and thereby tending to reduce gas pressure in the chamber, the passageway having an inlet, an outlet, and a flow path extending between the inlet and the outlet. An adjustment mechanism is for selectively adjusting a length of the path to change a rate of flow of gas from the chamber to the vent opening.

In yet one more aspect, a bleed system of the invention is for venting pressurized gas from a chamber to a vent opening at a selectively adjustable flow rate to control change of pressure in the chamber. The bleed system comprises a passageway establishing fluid communication between the chamber and vent opening for venting gas from the chamber and thereby tending to reduce gas pressure in the chamber. An adjustment mechanism is for selectively adjusting a size of the passageway to change a rate of flow of gas from the chamber to the vent opening. The adjustment mechanism comprises a conical plug movable within a conically-shaped bore.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1A:
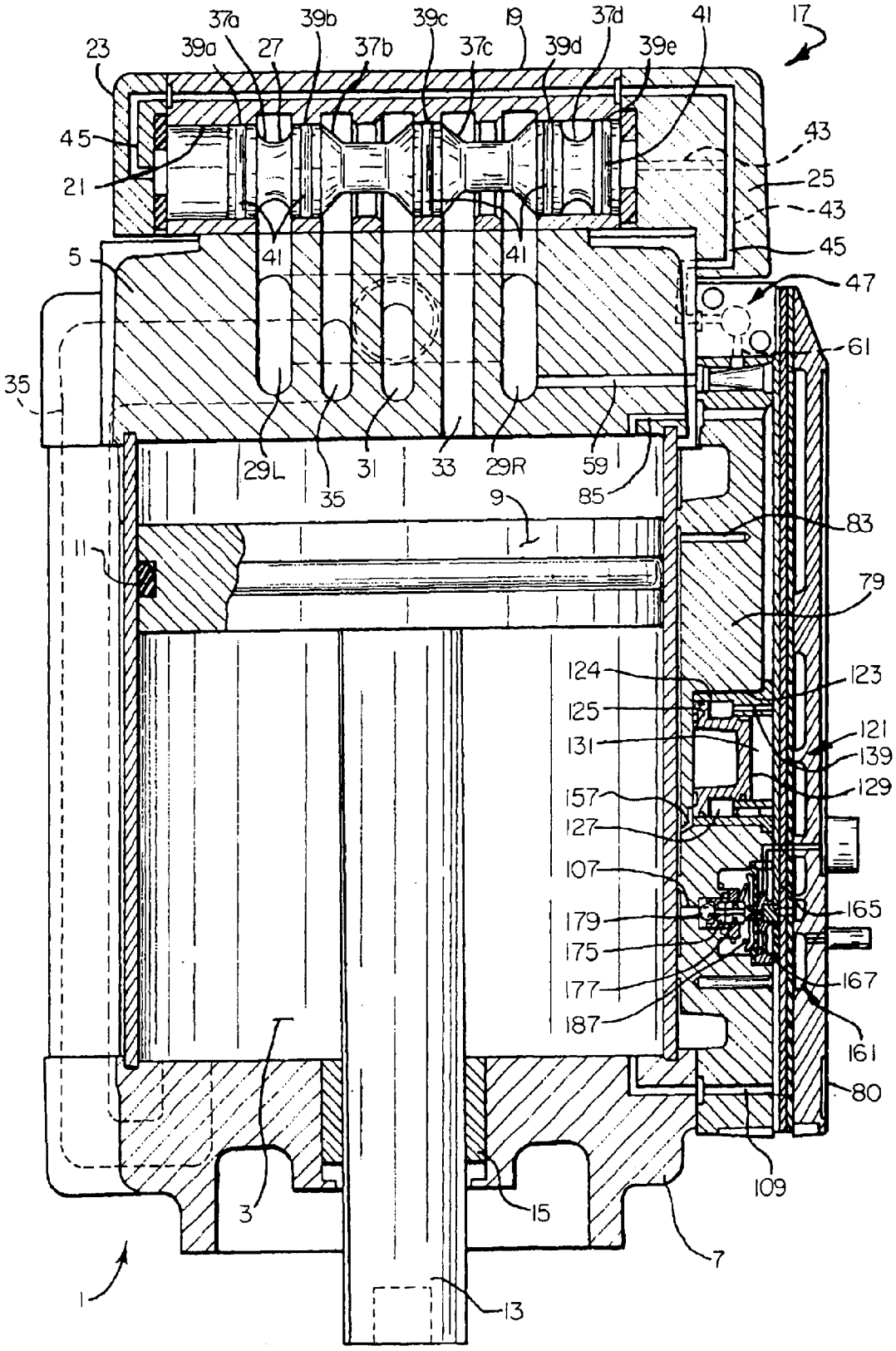
FIG. 1A PRIOR ART
FIG. 1A is a vertical section of an air motor and runaway control of the prior art.
Figure 1B:
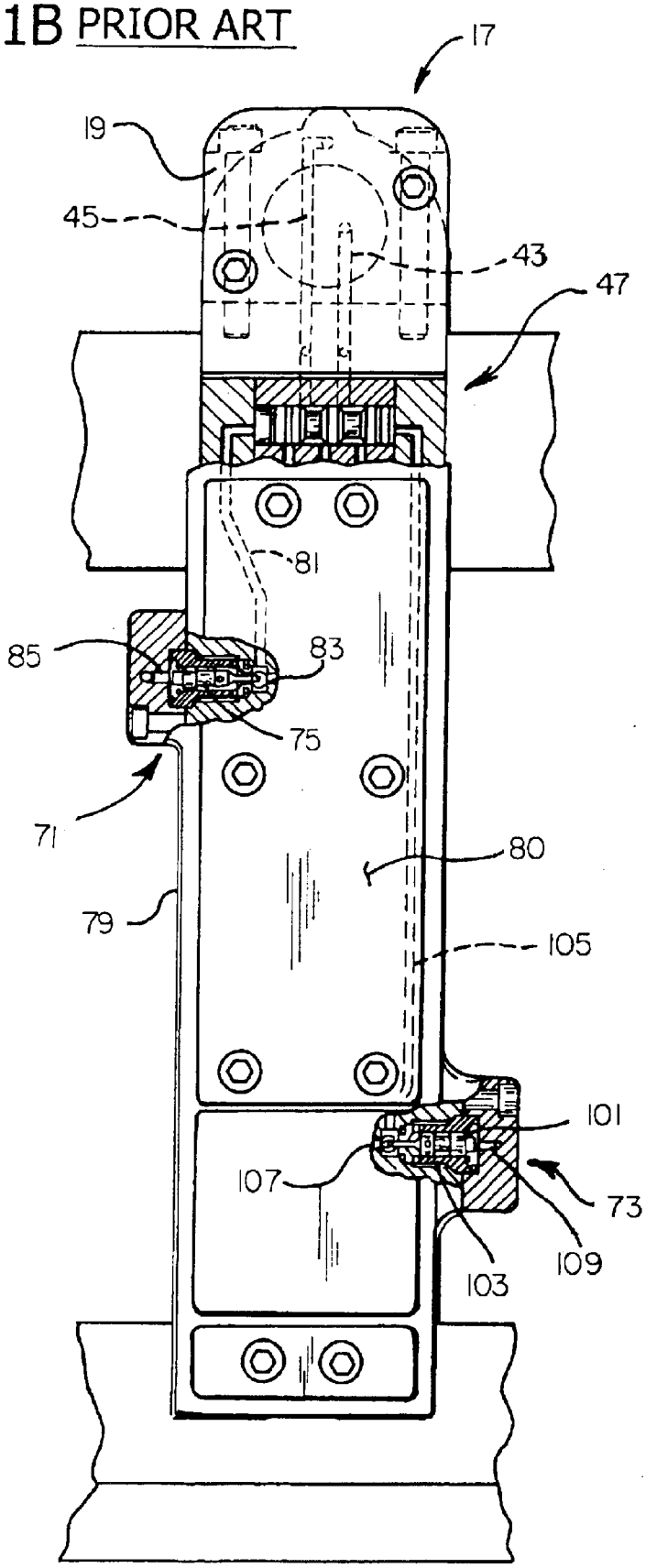
FIG. 1B PRIOR ART
FIG. 1B is a side elevation of the air motor and runaway control of FIG. 1A with portions broken away.
Figure 1C:
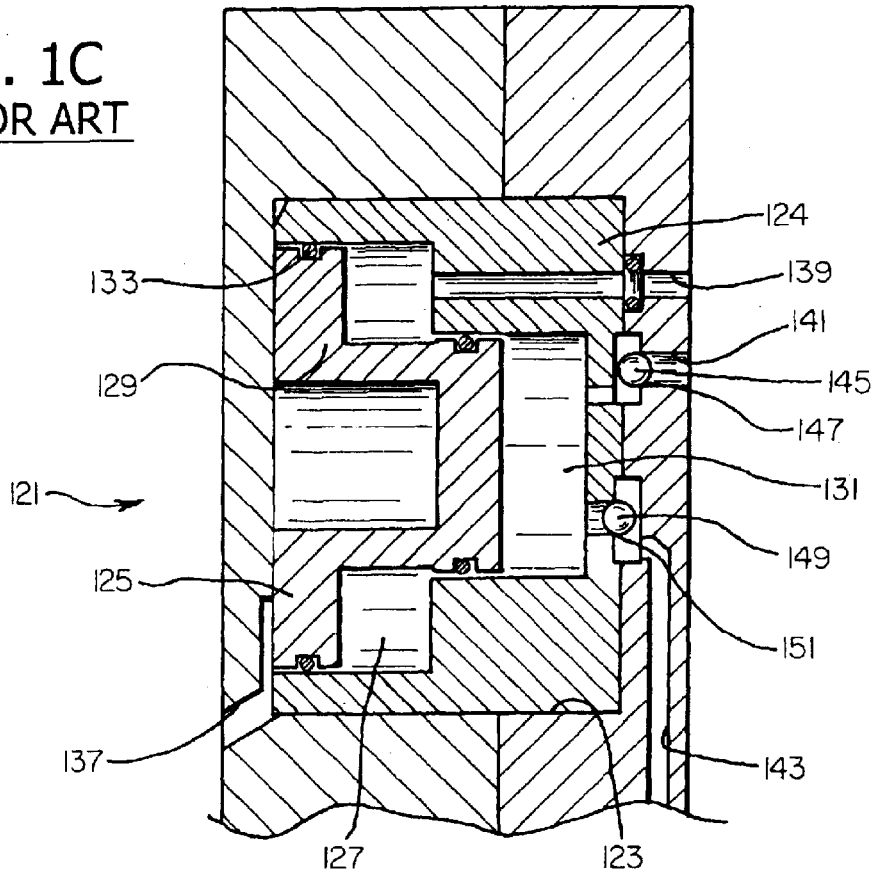
FIG. 1C PRIOR ART
FIG. 1C is an enlarged section of an air pump shown in FIG. 1A.
Figure 1D:
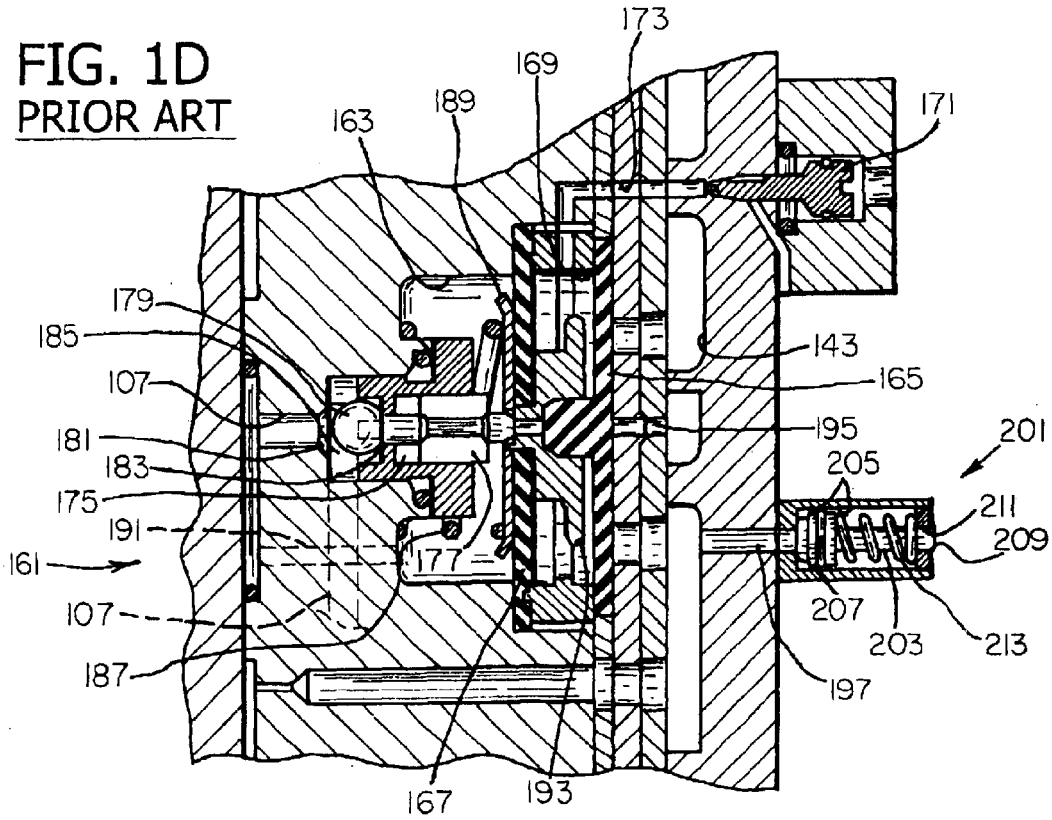
FIG. 1D PRIOR ART
FIG. 1D is an enlarged section of a pressure-responsive system shown in FIG. 1A.
Figure 2:
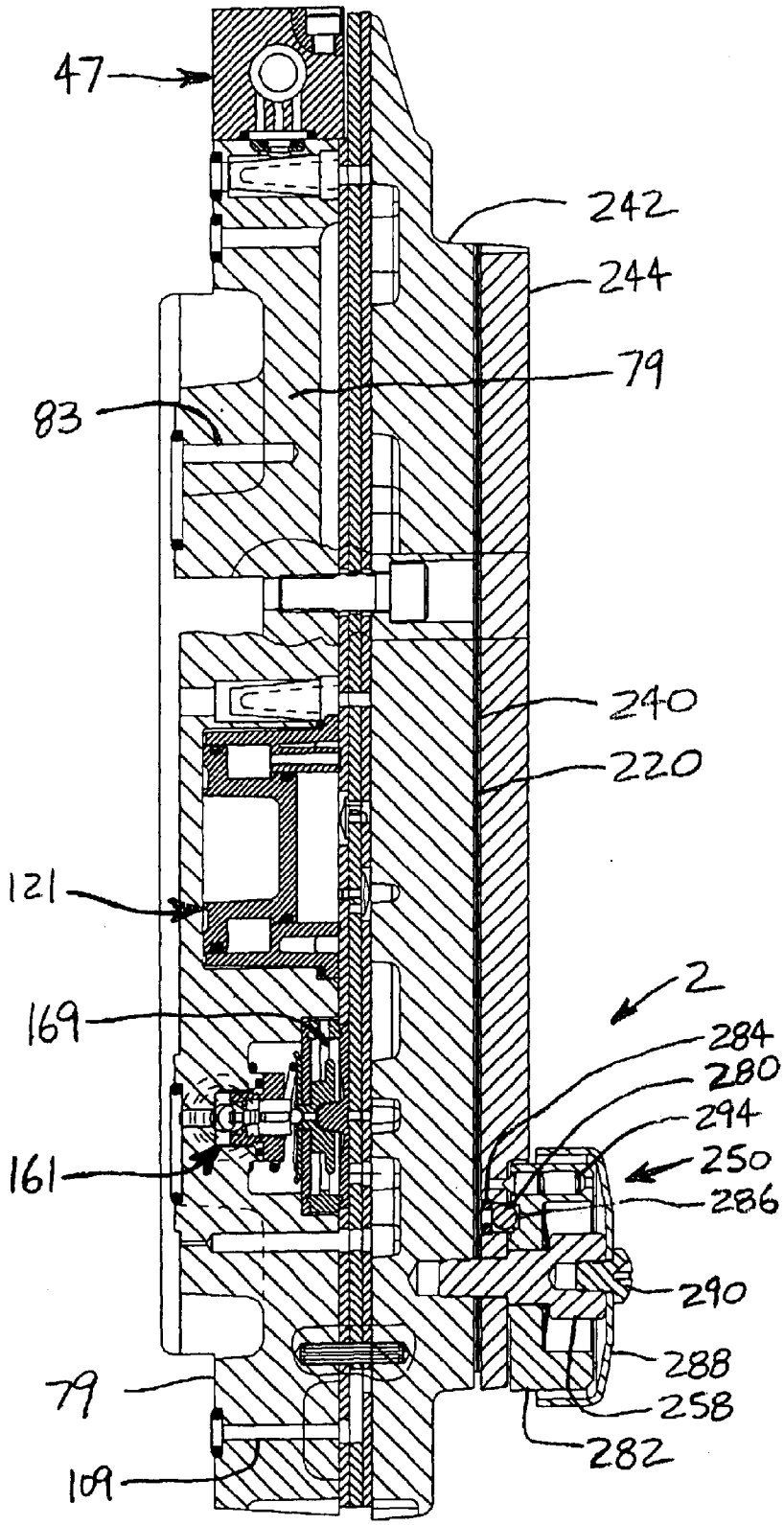
FIG. 2 is a vertical section of a runaway control and bleed system according to the present invention for mounting at one side of the air motor of FIG. 1A.
Figure 3:
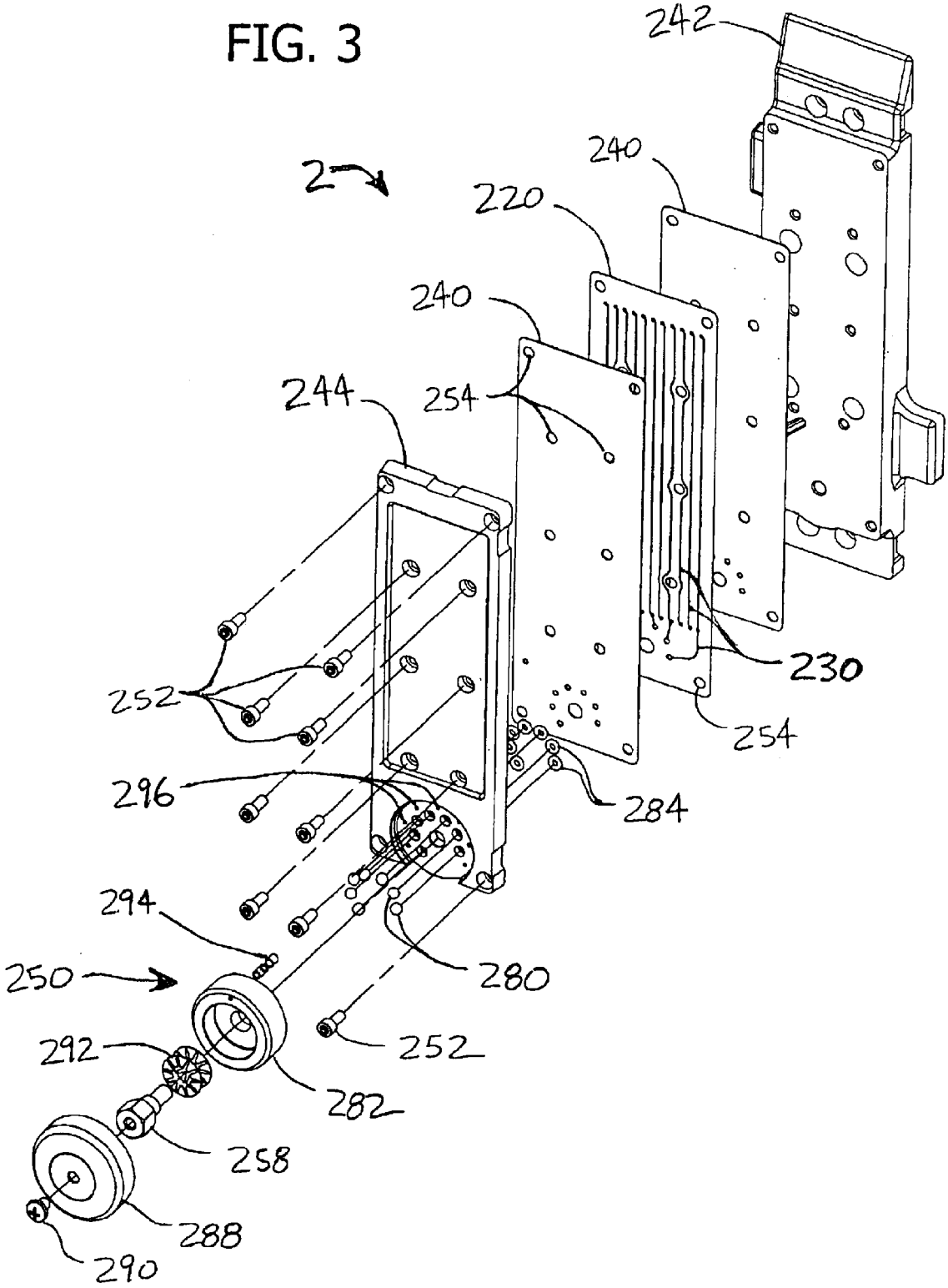
FIG. 3 is an exploded perspective of the runaway control and bleed system of FIG. 2.

Referring now to the drawings and in particular to FIGS. 2 and 3, a bleed system according to the present invention for venting pressurized gas at a selectively adjustable flow rate is indicated generally at 2. The bleed system 2 may be used, for example, in a runaway control for an air motor 1 of the type disclosed in FIGS. 1A–1D, although the system may be applied in any device wherein gas is released at a controlled rate.

The air motor 1 of the prior art, and its runaway control system, are now described with reference to FIGS. 1A–1D. In one embodiment, the bleed system 2 of the present invention is intended to replace a conventional bleed valve 171 (FIG. 1D) of the runaway control. The air motor 1 comprises a cylinder 3 which as generally used occupies a vertical position as shown in FIG. 1A and which has first and second end heads 5 and 7 at first and second ends thereof, the first being the upper and the second being the lower end head. The heads are secured on the upper and lower ends of the cylinder by bolts or tie rods (not shown) as in U.S. Pat. No. 4,846,045, which issued Jul. 11, 1989 and is entitled "Expansible Chamber Motor". A motor piston 9 is reciprocable up and down in the cylinder, having an O-ring seal as indicated at 11. A piston rod 13 extends down from the piston through the lower end head 7, an O-ring seal for the rod being indicated at 15. The piston rod is adapted for connection in conventional manner at its lower end to the plunger of a pump (not shown) for pumping materials such as lubricants, sealants, and inks.

A valve generally designated 17 is mounted on the upper end head 5 for controlling supply of pressure air from a source thereof to and exhaust of air from opposite ends of the cylinder 3. The valve comprises an elongate metal block 19 (e.g. a cast aluminum block) suitably secured on top of the upper end head having a cylindric bore 21 extending from one end thereof to the other and end heads 23 and 25 closing the ends of the bore. A valve member 27, more particularly a valve spool, is axially slidable in the bore between a first position toward the right end of the bore as shown in FIG. 1A, for effecting delivery of pressure air from a source to the upper end of the cylinder and exhaust of air from the lower end of the cylinder for driving the piston down, and a second position toward the left end of the bore for effecting delivery of pressure air from the source to the lower end of the cylinder and exhaust of air from the upper end of the cylinder for driving the piston upwardly. Pressure air is supplied from a suitable source to pressure supply ports 29L and 29R in the upper end head 5 which are in communication with the bore 21 in the valve block. At 31 is indicated an exhaust port in communication with the bore and with the ambient atmosphere. Delivery to and exhaust of air from the upper end of the cylinder (i.e., the chamber in the cylinder above the piston) is via passaging in the upper end head indicated at 33. Delivery to and exhaust of air from the lower end of the cylinder (i.e., the chamber in the cylinder below the piston) is via passaging indicated at 35. The valve spool is constructed as illustrated with annular grooves 37*a*, 37*b*, 37*c* and 37*d* between lands 39*a*, 39*b*, 39*c* and 39*d* to establish communication between ports 29R and 33 and between ports 35 and 31 when in its right-hand position of FIG. 1 and to establish communication between ports 29L and 35 and between ports 33 and 31 when in its left-hand position. The lands have seals such as indicated at 41.

The valve spool 27 is movable from its right-hand position of FIG. 1A to its left-hand position on delivery of pressure air to the right end of the bore 21 through passaging indicated at 43 in the upper end head 5 and in the valve block end head 25, and exhaust of air from the left end of the bore via passaging indicated at 45 in the left end head 23 of the valve block 19. The valve spool 27 is movable from its left-hand position to its right-hand position on delivery of pressure air to the left end of the bore 21 via passaging 45 and exhaust of air from the right end of the bore via passaging 43. The supply of air to and exhaust of air from the opposite ends of the bore 21 are under control of an air-operated relay valve 47 (desribed in U.S. Pat. No. 5,349,895) to establish communication for pressure air from pressure supply port 29R in the upper end head 5 of the cylinder 3 via a passage 59 to a port 61 and thence via passaging 45, and for exhaust of air from the right end of the bore 21 via passaging 43 to an exhaust port.

For operation of the relay valve 47, means indicated generally at 71 is provided for delivery of air under pressure to and exhaust of air from the left end of the relay valve and means indicated generally at 73 is provided for delivery of air under pressure to and exhaust of air from the right end of the relay valve. The means 71, 73 comprise a first pilot valve 75 (FIG. 1B) and a second pilot valve 101, respectively, housed in a recess of a block 79 mounted at one side of the cylinder. The first pilot valve 75 is a pressure responsive valve in communication by passaging as indicated at 81 with the relay valve 47. The pilot valve is also in communication by passaging as indicated at 83, 85 with the cylinder 3. The second pilot valve 101 is mounted in a recess 103 of the block 79. The pilot valve is also a pressure responsive valve in communication by passaging as indicated at 105 to the relay valve 47, and by passaging as indicated at 107, 109 with the cylinder 3. Further description of the pilot valves is provided in U.S. Pat. No. 5,349,895. A cover member 80 encloses the outer surface of the block 79 such that the required passaging between means 71, 73 and the relay valve 47 is located between the block and the cover member.

An air pump, generally designated 121 in FIGS. 1A and 1C operates as a slave to the air motor and is housed in a recess 123 in the side of the block 79. Air pump 121 comprises a cylinder 124 having a first chamber constituting a motor chamber 127 and a second chamber constituting a pump chamber 131, and a piston 125 reciprocally movable in the motor chamber, and a plunger 129 movable conjointly with the piston in the pump chamber. As shown, the plunger 129 has a smaller diameter than piston 125 and extends from and is integral with the piston. O-rings maintain an air-tight seal between the piston and the motor chamber and between the plunger and the pump chamber so that pressurized air in the chambers does not escape.

The motor chamber 127 is in communication with the bottom of the cylinder 3 via passaging 137 (FIG. 1C) located at the left end of the motor chamber, and in communication with top of the cylinder via passaging 139 located at the right end of the motor chamber. Upon increase of pressure in the bottom of cylinder 3, pressurized air is delivered to the air pump 121 through passaging 137 thereby forcing the piston 125 to the right to a first position, and upon an increase of pressure in the top of the cylinder 3, pressurized air is delivered to the air pump 121 through passaging 139 thereby forcing the piston 125 back to the left to a second position. When the piston 125 moves to its second position, the plunger 129 draws in atmospheric air into the pump chamber 131 through a vent 141. And, upon moving to its first position, the plunger 129 forces the air in the pump chamber 115 through a passageway 143. A ball check 145 engagable with a seat 147 is provided in vent 141 for preventing air in the pump chamber 131 from flowing back through the vent when the plunger 129 moves from its first position to its second position, and likewise, an identical ball check 149 engagable with a seat 151 is provided in passageway 143 for preventing the plunger 129 from drawing air into the pump chamber 131 when the plunger moves from its second position to its first position.

Passageway 143 connects the air pump 121 to pressure-responsive system, indicated generally at 161, which is located in a recess 163 in block 79 adjacent the air pump. The pressure-responsive system 161 comprises a first diaphragm 165 located at the right side of the recess and a second diaphragm 167 proximate the first diaphragm 165 and to the left thereof. As shown in FIG. 1D, the space between diaphragms 165 and 167 defines a chamber 169 which receives pressurized air from the air pump 121 via passageway 143. Upon delivery of pressurized air from the air pump 121 to the chamber 169, the air is vented from the chamber by a conventional bleed valve 171 in communication with the chamber via a passageway 173 at a rate consistent with the predetermined operating speed of the air motor. Bleed valve 171 is adjustable for varying the rate of bleed from chamber 169, i.e., the bleed may be adjusted to vent a maximum quantity of air when operating the air motor at an increased rate, or adjusted to vent a minimal quantity of air when operating the motor at a nominal rate.

Pressure-responsive system 161 further comprises a pressure-responsive valve 175 ("movable means") movable within the recess 163 upon an increase in pressure in chamber 169. Valve 175 includes a valve stem 177 which is connected at its right-hand end to the second diaphragm 167 and at its left-hand end to a ball valve member 179, the ball valve member being engagable with a first valve seat 181 located to the left of the ball valve member and a second valve seat 183 located to the right of the ball valve member. The space between valve seats 181, 183 defines a passage chamber 185 which is in communication with passaging 107 such that air traveling through the passaging must enter into and exit from the chamber 185 as the air travels to relay valve 47. The pressure-responsive valve 175 is movable from a first position in which the ball valve member 179 engages the second valve seat 183 (and spaced from the first valve seat 181) such that air flows through passaging 107 to maintain communication between cylinder 3 and pilot valve 101, and in response to increase in air pressure in the chamber 169 above a predetermined limit to a second position in which the ball valve member 179 engages the first valve seat 181 for blocking passaging 107, and therefore blocking flow of air to pilot valve 101. On blocking of passaging 107, the pilot valve 101 is unable to operate, thereby disabling the operation of the relay valve 47 which in turn disables the valve spool 27 for stopping the movement of piston 9 and cutting off the operation of the motor 1. The pressure-responsive valve 175 is movable back to its first position on reduction of pressure in the chamber 169 below the limit.

A spring 187, engageable with a washer 189 positioned adjacent the second diaphragm 167, biases the second diaphragm to maintain the pressure-responsive valve 175 in its stated first position. Upon increase of speed of the motor above a predetermined operating speed (e.g., 50 cycles per minute as set by bleed 171), the air pump 121, operating at increased speed, delivers air under pressure at an increased rate to the chamber 169 over and above the capability of the bleed 171 to bleed off the increase and over and above the resistance of the spring 187 on the second diaphragm 167. On the ensuing increase in air pressure in the chamber above the limit, the second diaphragm moves to the left against the bias of the spring so that the pressure-responsive valve 175 moves to its second position thereby blocking passaging 107 and cutting off the motor. A vent 191 exhausts built-up air pressure to the left of the second diaphragm to the atmosphere.

The previously described arrangement is such that the length of time from when the air motor reciprocates at the predetermined speed limit to when the air motor is cut off depends upon how much over the speed limit the air motor is reciprocating. The greater the speed of the motor, the shorter the length of time for increasing air pressure within chamber 169 over and above the resistance of spring 187 for moving pressure-responsive valve 175 to its second position. And conversely, a speed only marginally above the speed limit delivers pressurized air to chamber 169 at a slower rate, thereby increasing the amount of time needed to move the valve 175 to its second position.

The first and second diaphragms 165, 167 are interconnected at their respective centers by a member 193. The first diaphragm 165 is also biased by the spring 187 (via the force of the spring transmitted through diaphragm 167 and member 193) against the right-hand wall of the recess 163 to block a passageway 195 which is connected to the source of pressure air for supplying pressurized air on diaphragm 165 (which constitutes an auxiliary valve member). The pressurized air assists in moving the pressure-responsive valve 175 to its second position. On the initial movement of the pressure-responsive valve 175 to its second position (as a result of increased pressure in chamber 169), the first diaphragm 165 moves away from the passageway 195 to an open position and pressurized air exerts pressure on the first diaphragm for facilitating the movement of the pressure-responsive valve to its second position. Only by closing the air supply and venting the air trapped in the recess 163 to the right of the first diaphragm may the pressure-responsive valve move back to its first position.

A trip indicator, indicated generally at 201, located on the exterior of the block 79 is in communication with the recess 163 to the right of the first diaphragm 165 by another passageway 197 and is activated upon increased pressure to the right of the first diaphragm as a result of pressurized air being supplied by the air supply. As shown in FIG. 1D, the trip indicator 201 includes a valve stem 203 slidable within a bore 205. Upon increased air pressure on the left-hand portion 207 of valve stem, it moves towards the right so that a narrower right-hand portion 209 of the stem extends through an opening 211 formed in the block 79. A spring 213 maintains the trip indicator 201 towards the left in the bore and only upon delivery of supply air on the left hand portion 207 of the stem 203 is the stem able to move against the bias of the spring. The right-hand and portion 209 of the stem 203 is colored red so that it may be visible to the operator. Upon activating the trip indicator 201, the operator knows that the air motor runaway control has been activated and that the air motor needs to be reset by shutting off the pressurized air.

During operation of the air motor, piston 9 is movable up and down in cylinder 3 in response to pressurized air delivered by valve 17. Piston 9 drives the plunger of the pump (not shown) connected at the lower end of the piston rod 13 for pumping materials such as sealants. In the event of the discharge line of the pump breaking, or exhaustion of the supply of the material being pumped, the piston 9 will tend to reciprocate in the cylinder 3 at high speed which can cause significant damage to the pump. In response to the increased speed of the piston 9, the air pump 121 of the runaway control operates at an increased speed since the air pump operates as a slave to the air motor. The air pump 121 in turn delivers pressurized air at an increased rate to chamber 169 of the pressure-responsive system 161. The pressure in the chamber 169 is controlled by bleed 171 via which the air entering the chamber from air pump 121 is vented from the chamber at a rate consistent with the predetermined operating speed of the air motor. In response to increase of air pressure in the chamber 169 over and above the capability of the bleed 171 to bleed off the increase, the pressure-responsive valve 175 moves to its second position in which its ball valve member 179 engages the first valve seat 181 for blocking passaging 107. The first diaphragm 165 also moves to a position away from passageway 195 thereby allowing air pressure to be delivered on the first diaphragm for maintaining the blockage of passaging 107.

By blocking passaging 107, the second pilot valve 101 is incapable of allowing the delivery of pressurized air to passaging 105 for moving the relay valve 47 because pressurized air from the lower end of the cylinder entering passaging 107 above the piston when the piston is in its substantially down-stroke position is blocked from entering the second pilot valve 101. Since the relay valve 47 is incapable of moving, the valve spool 27 of the valve means 17 is incapable of moving to its left-hand position. Pressurized air from supply port 29R continues to be supplied to passaging 45 which keeps valve spool 27 in its right-hand position. With the valve spool 27 maintained in its right-hand position, pressurized air from supply port 29R continues to be supplied to the top of the cylinder 3 via passaging 33 above piston 9 thereby holding the piston in its down-stroke position.

By shutting off the air supply (which applies pressure on diaphragm 165) and opening the bleed 171 for venting the built-up air pressure in the chamber 169, the air motor is reset for operation. Upon releasing the built-up air pressure in the chamber 169, the pressure-responsive valve 175 moves back to its first position under the bias of spring 187. Before the air motor is restarted, however, the cause for the air motor runaway must be attended to, e.g., the broken discharge line should be replaced, or the material being pumped should be resupplied.

Reference is made to U.S. Pat. No. 5,349,895 for further detail regarding the runaway motor control.

The bleed system 2 of the present invention is now described with reference to FIGS. 2, 3, 4A, and 4B. In the embodiment shown in the drawings, the bleed system includes a thin, flat plate 220 having channels 230 formed in one face of the plate, two gaskets 240 for sealing engagement with opposite faces of the plate, an inner housing member 242, an outer housing member 244, and a selector mechanism indicated generally at 250. The inner and outer housing members 242, 244 are clamped together and attached to the air motor 1 by suitable fasteners such as ten cap screws 252, with the gaskets 240 and plate 220 held in sandwiched position between the inner and outer housing members. The plate 220 has ten holes 254 for permitting the cap screws 252 to pass through the plate, and one fastener hole 256 for permitting a fastener bolt 258 of the selector mechanism to pass through the plate. The housing members 242, 244 are made of a suitable rigid material, such as cast steel or aluminum.

Figures 4A, 4B:
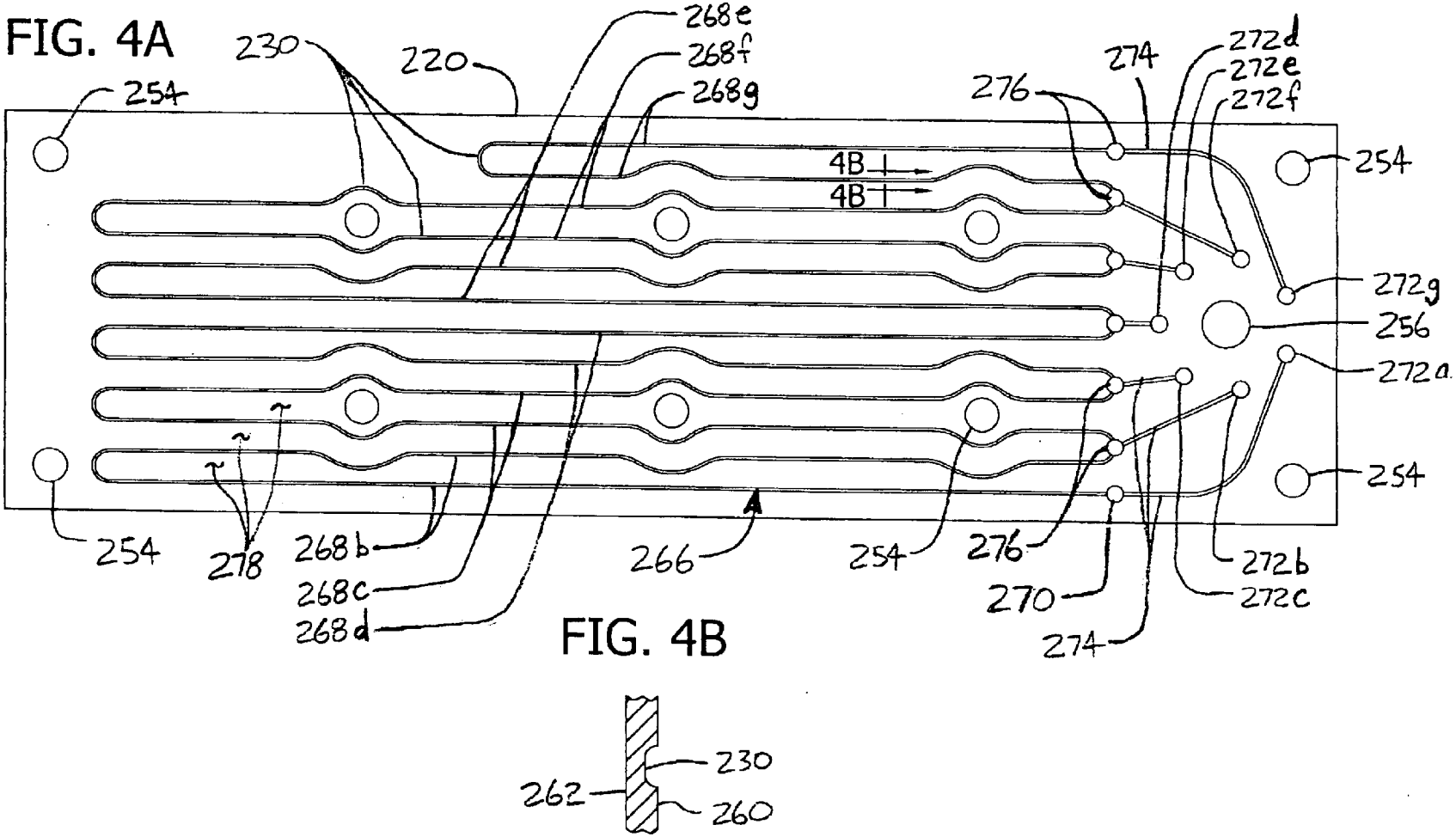
FIG. 4A is a view showing a face of a plate of the bleed system and its passageways.
FIG. 4B is an enlarged section along line 4B—4B of FIG. 4A.

Each gasket 240 comprises a piece of a suitable rubber or plastic for generally airtight sealing against a face of the plate 220 and closing open sides of all channels 230 on the plate. Other types of sealing arrangements do not depart from the scope of this invention. The gasket has holes 254, 256 corresponding with those on the plate 220 for registering alignment therewith. As shown in FIG. 4B, the plate 220 has channels formed in a front face 260 of the plate, with a back face 262 being smooth. Consequently, the bleed system 2 requires only one gasket 240 to close the open side of the channels 230 by face-to-face engagement with the plate and thereby seal each channel (although two gaskets may be installed without any detriment).

Significantly, the channels 230 in the plate define a plurality of alternate air bleed flow paths or passageways having different lengths and providing different resistances (e.g., friction) to flow of gas through the passageways. Consequently, selection of one passageway results in flow of gas at one flow rate and selection of another passageway results in flow of gas at a different flow rate. It is understood that systems of other forms, including but not limited to channels formed in other objects (which are neither thin nor flat) or channels comprising stand-alone pipes, conduits, or passageways, do not depart from the scope of this invention.

Referring to the embodiment of FIG. 4A, the channels 230 defining the passageways are arranged in series. The channels are formed in this particular embodiment by a single continuous groove as indicated generally at 266 which has a sinuous shape, also referred to as forming a tortuous path, comprising a series of down-and-back segments or reaches 268*b*–268*g* extending along the length of the plate 220. Each bleed flow path or passageway has an inlet and an outlet. A hole in the plate indicated at 270 comprises a common inlet for all passageways, and it is in communication with passageway 173 and the pressurized chamber 169 of the runaway control from which air is to be continuously released at a controlled rate. The plate 220 has a plurality of outlet holes 272*a*–272*g* spaced at intervals around the fastener hole 256, seven such outlet holes being shown in FIG. 4A for purposes of illustration. (It will be understood that the number of outlet holes 272 or inlet holes 270 may vary.) Each outlet hole 272 is connected to the continuous groove 266 by means of a connector channel 274. The intersections 276 between the connector channels 274 and the continuous groove 266 are spaced along the groove at different distances from the common inlet 270 to form a plurality of passageways (bleed flow paths) of different lengths, the length of each such passageway being the distance along the groove 266 between the inlet 270 and a respective intersection 276 plus the distance along a respective connector channel 274 from the intersection to the respective outlet hole 272. It is understood that a system with separate channels of differing resistances, such as a distinct channel of selected length for each outlet, does not depart from the scope of this invention.

The plate 220 of FIGS. 4A and 4B has a shape and size suitable for attachment and use with the air motor runaway control. In one embodiment, the plate is rectangular with approximate dimensions of 7.5×2.4×0.015 inches. Larger plate sizes can permit longer passageways. The plate 220 is formed of a suitable material such as brass, stainless steel, or aluminum, and has a smooth surface finish. It is understood that there can be multiple plates or other objects containing channels which are placed adjacent to one another, or stacked together, without departing from the scope of this invention. Each channel 230 is arranged in spaced relation from adjacent channels and holes 254 to avoid close proximity to other channels and holes and thereby provide flat areas or lands 278 immediately adjacent each channel for the gasket(s) 240 to seal against and ensure airtight sealing of the channels and holes. These spacings preferably range from 1/16 to 3/16 inch.

The channels 230 are formed on the face of the plate 220 with a conventional chemical etching process, as known to those skilled in the art, such as by exposing the plate to an acid to remove material from selected locations. In one embodiment, all channels 230, 274 have a uniform cross-sectional area which remains uniform along an entire length of each channel. Although a variety of cross-sectional sizes or shapes are possible, in a preferred embodiment each channel has a width of about 0.015 inch, a depth of about 0.006 inch, and features a generally rounded shape with a flat bottom as shown in FIG. 4B. It is understood that systems with passageways of other shapes and configurations do not depart from the scope of this invention. Further, a system wherein resistance to air flow is varied by passageway cross-sectional area (instead of length), or by a combination of cross-sectional area and length, does not depart from the scope of this invention.

The selector mechanism 250 (FIGS. 2 and 3) is movable between different settings corresponding to the different passageways, and it places a selected one of the outlets (outlet holes 272) into communication with the inlet 270, with other outlets remaining closed. Each of a plurality of valve members 280 (seven in the embodiment shown in the drawings) is movable between a closed position in which it is seated at a respective outlet to seal the outlet and an open position to permit airflow through the outlet. A selector device 282 holds the valve members 280 in their closed positions.

In one embodiment, the valve members 280 comprise spherical balls and the selector device 282 comprises a knob which is rotatable by a user for moving one valve member to its open position and thereby placing one selected outlet in communication with the inlet. Referring to FIG. 3, the outer housing member 244 has a recess for receiving the knob 282 and seven holes in the recess for receiving the balls 280 and holding the balls in registering alignment with respective outlet holes 272 of the plate. An o-ring seal 284 is positioned beneath each ball 280 forming a seat for the ball. The fastener bolt 258 attaches the knob 282 to the outer housing member 244 at a position such that the bottom surface of the knob presses the balls 280 into airtight engagement with the o-rings 284 while being movable relative to the balls to maintain the ability to rotate the knob. The bottom surface of the knob has one recess 286 (FIG. 2) which permits one ball 280 to move into the recess, as it is urged by the resiliency of its o-ring 284 and air pressure, to an unseated position such that air can flow out from a respective passageway of the plate 220 through the corresponding outlet hole 272. Rotation of the knob 282 places the recess 286 over a selected outlet hole 272. Air from the groove 266 is then free to exit the plate 220 via the selected flow path and outlet, passing by the ball 280 and flowing out around the knob 282 to the surrounding air at atmospheric pressure.

The selector mechanism 250 also includes a cover 288, a cover fastener 290, and a washer 292 placed between the bolt 258 and knob 282. Preferably, the washer 292 is a Belleville type washer which augments pressing of the knob against the sealing balls 280. A conventional tactile detent 294 (FIG. 2) is held in the knob, such as a spring-loaded, extendable pin. The pin is receivable in indentations 296 (FIG. 3) of the outer housing member 244 for alignment purposes. The detent 294 provides the user with a difference in sensed resistance or noise (e.g., a click) to indicate that the knob 282 is set at a position wherein one of the balls 280 is unseated. Other types of selector mechanisms do not depart from the scope of this invention.

In use, the bleed system 2 of the present invention provides a release of gas at a selectively adjustable flow rate. The rate of flow varies generally inversely with the resistance. By rotating the knob 282 of the selector mechanism, the user selects a longer or shorter passageway through which air must pass and a correspondingly larger or smaller resistance to flow. When the first outlet 272*a* is selected, air has a minimum distance to traverse on the plate. Specifically, air travels only through one connector channel 274, from the inlet 270 to the outlet 272*a*. When the second outlet 272*b* is selected, air must travel one down-and-back reach 268*b* along the plate. Successive outlets provide additional length, with incremental addition of one successive down-and-back reach 268 in series for each outlet. When the final (seventh) outlet 272*g* is selected, air must traverse all six of the down-and-back reaches 268*b*–268*g* on the plate, thereby providing maximum frictional resistance and minimum flow rate. It is understood that other arrangements, such as passageways having distinct inlets or which are not arranged in series, alternative patterns, orientations, channel densities or spacings, or a fewer or greater number of channels, inlets, or outlets, do not depart from the scope of this invention. The reaches may have equal lengths resulting in approximately equal increments in resistance to airflow, or alternatively may vary, as shown by the final (sixth) reach 268*g* on FIG. 4A which is relatively shorter, to vary incremental resistance.

The bleed system 2 of the present invention is repeatable because flow paths and cross-sectional areas do not change from one use to the next. There is no variation due to manufacturing tolerances as with conventional bleed valves. Consequently, the bleed system may be accurately calibrated for flow rate or other variable of interest. For use with the air motor 1, settings of the knob 282 may be calibrated corresponding to specific speed limits so that the maximum, predetermined cut-off speed of the air motor can be selected, e.g., 50 or 75 cycles per minute. The bleed system is attached to the air motor as shown in FIG. 2, and it replaces the bleed valve 171 of the prior art. With the exception of that replacement and the improvements resulting therefrom as described above, the air motor 1 and runaway control are unchanged. The bleed system is reliable, durable, and inexpensive to produce.

The bleed system can be used in other applications, e.g., compressors, valve systems, fuel injectors, power generator systems, medical and dental devices, and spraying systems.

Figure 5A:
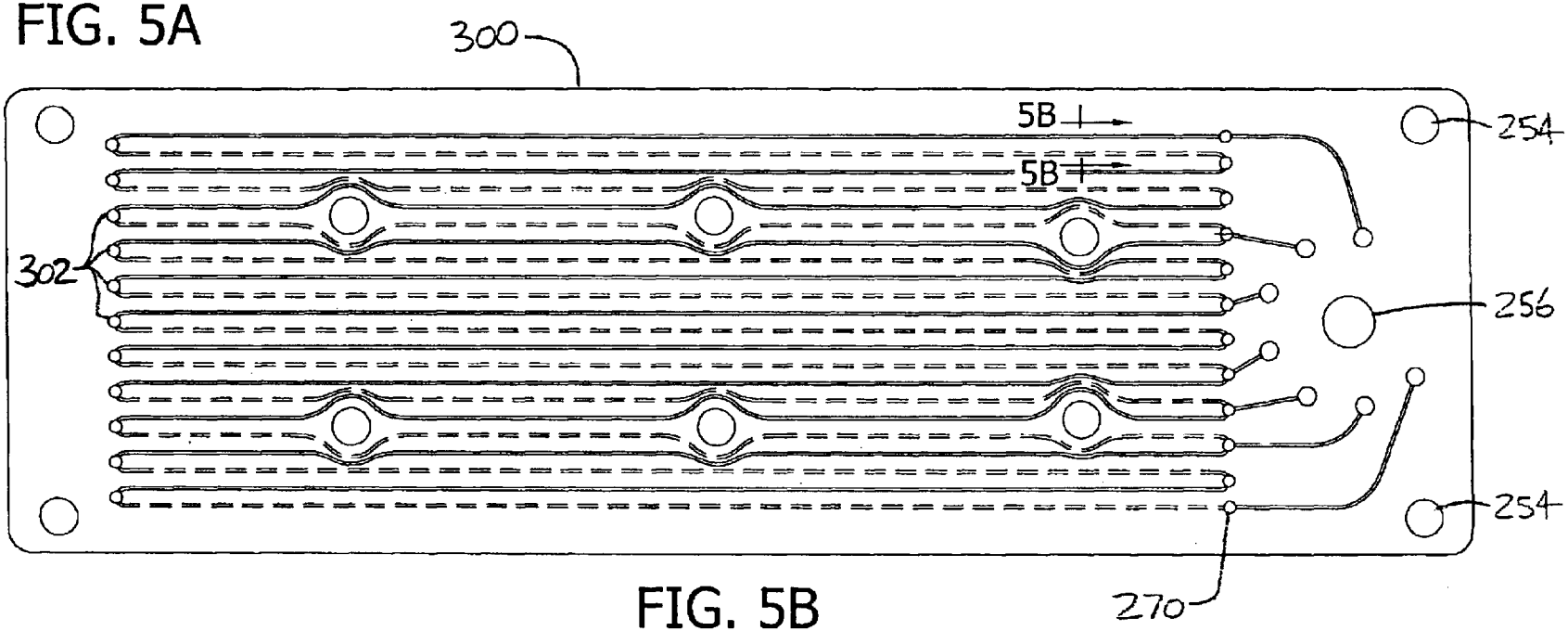
FIG. 5A is a view similar to FIG. 4A showing a face of a plate of a second embodiment.
Figure 5B:
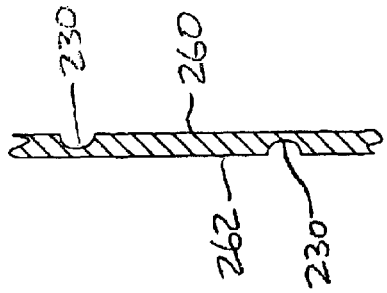
FIG. 5B is an enlarged section along line 5B—5B of FIG. 5A.

A second embodiment of the invention (FIGS. 5A and 5B) includes a plate 300 with channels 230 formed in both opposing faces 260, 262. The plate 300 has connecting holes indicated at 302 for passing air from a channel 230 on the front face 260 to a channel on the back face 262. The arrangement is such that turning the selector knob 282 to successive outlet holes 272 increments the distance traveled by the air by one, two or more down-and-back reaches 268 of grooving. This configuration increases the length of passageway on the plate compared to a plate 220 of the first embodiment having single face grooves, and is done so without increasing the size of the plate or density of grooves. For example, when the second outlet 272*b* is selected on the plate of FIG. 5A, air must travel two reaches 268 along the length of the plate, whereas only one reach is traversed on the plate of FIG. 4A. Thus, the plate 300 of the second embodiment of FIG. 5A provides additional length and air resistance. Two gaskets 240 are required for sealing passageways on both faces of the plate 300.

Figure 6:
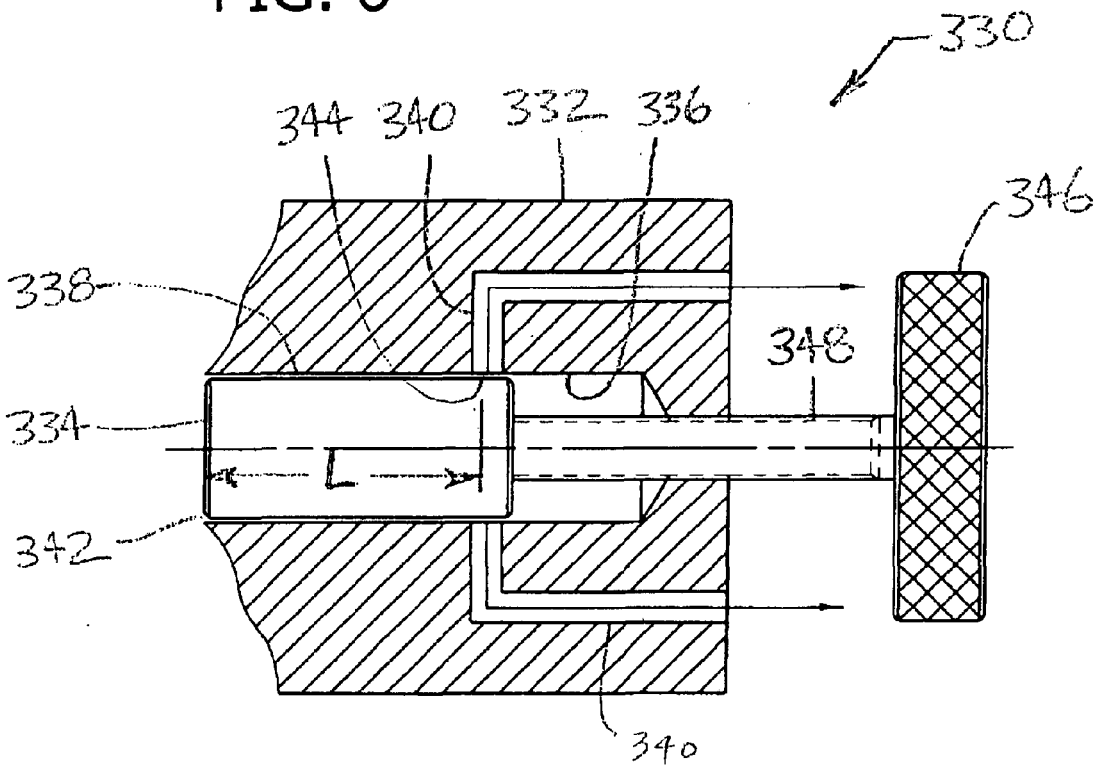
FIGS. 6–8 are schematic sections of third, fourth and fifth embodiments, respectively.

A third embodiment of the invention, shown schematically in FIG. 6, includes a bleed system indicated generally at 330. The system 330 comprises a bleed valve 332 which replaces the prior art bleed valve 171 of FIG. 1D. The valve 332 is in communication with passageway 173 and adjustable for varying the rate of bleed from chamber 169 to change the cut-off speed of the air motor 1. The bleed valve 332 includes a piston 334 movable in a bore 336. Advantageously, the piston and bore have circular cross-sections, although other shapes are acceptable. The piston 334 has a size which is slightly smaller than the bore 336 thereby providing a clearance fit. An annular gap between the piston and bore defines a passageway 338 for flow of gas. The gas is then vented through passages 340 to the surrounding air. An inlet 342 of the passageway 338 is positioned adjacent a distal end of the piston (the left hand end in FIG. 6), and an outlet 344 is defined along the bore 336 at the beginning of each passage 340.

An adjustment mechanism comprising a knob 346 is provided for varying a length L of the passageway 338. The knob is firmly connected to piston 334 by a rod 348 such that translation of the knob moves the piston in the bore. A locking mechanism (not shown) is provided to fix the knob 346 and piston 334 at selected positions.

Movement of the piston varies the length L of the passageway 338 between inlet 342 and outlet 344 to vary resistance to flow of gas through the passageway. The location of inlet 342 varies with movement of the piston, while location of outlet 344 is fixed, such that the length of the path is adjustable. Significantly, the length L of the path is continuously adjustable (i.e., is not limited to discrete increment or decrement units) as the piston is moved to any selected position. Consequently the cut-off speed of the air motor 1 may be adjusted with improved resolution.

Figure 7:
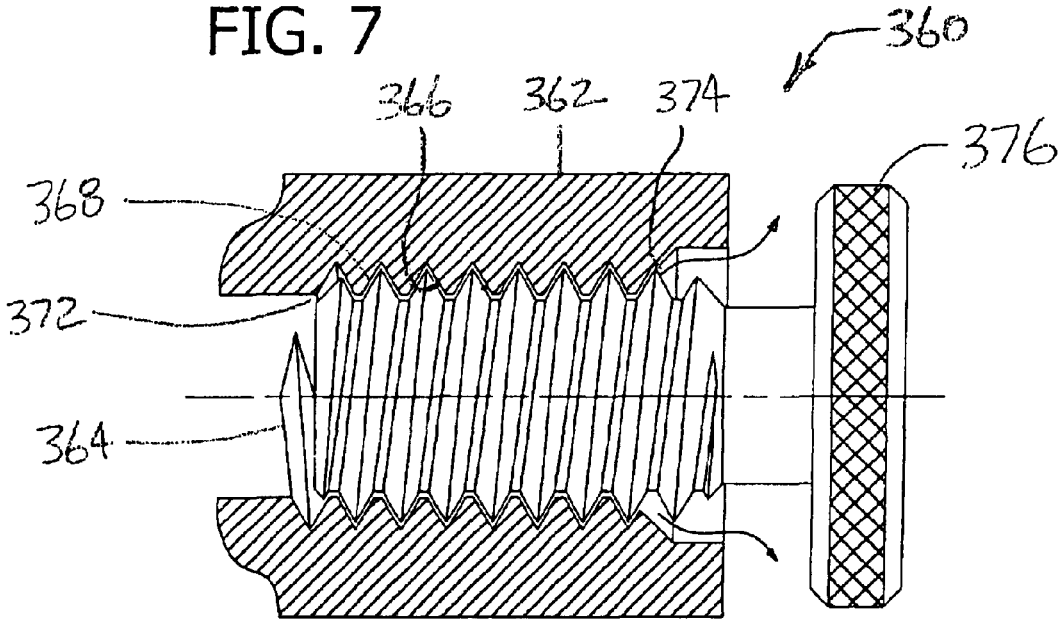

A fourth embodiment of the invention, shown in FIG. 7, includes a bleed system indicated generally at 360. A bleed valve 362 comprises a threaded screw 364 received in a threaded bore 366 defining a gas passageway 368 extending in a helical path along the threads. Rotation of the screw adjusts the length of the passageway to vary resistance to flow of gas through the passageway. An inlet 372 of the passageway 368 is positioned adjacent a distal end of the screw (the left hand end in FIG. 7), and an outlet 374 is defined along the bore 366 at an expanded opening. An adjustment mechanism comprising a knob 376 is provided for rotating the screw and varying the length of the passageway 368 between the inlet 372 and the outlet 374. A locking mechanism (not shown) is provided to fix the knob 376 and screw 364 at selected positions. The length of passageway 368 is continuously adjustable as the screw is moved to any selected position so that the cut-off speed of air motor 1 may be adjusted with improved resolution.

Figure 8:
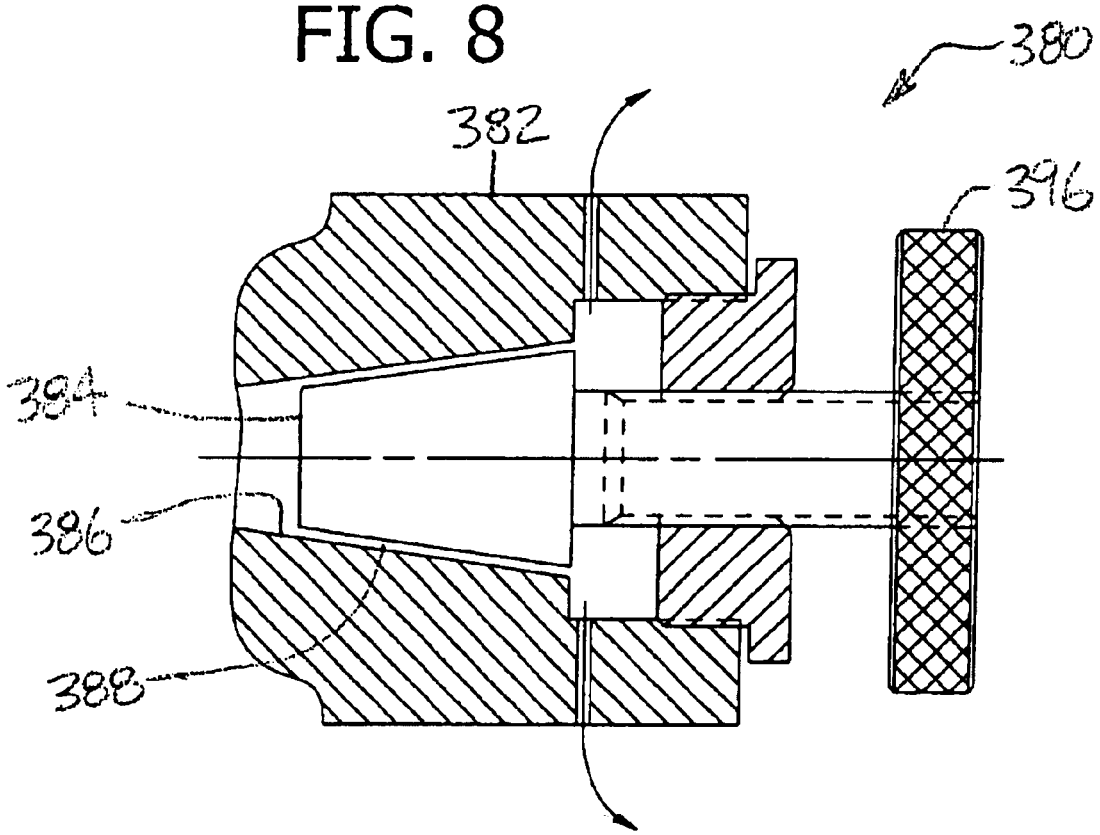

A fifth embodiment of the invention, shown in FIG. 8, includes a bleed system indicated generally at 380. A bleed valve 382 comprises a plug 384 having a conical shape movable within a conically-shaped bore 386 having a taper generally corresponding with the shape of the plug. Advantageously, the plug 384 comprises a frustum although other shapes are suitable. A gas passageway 388 is defined in an annular gap between the plug and the bore. Movement of the plug 384 by adjustment knob 396 changes both clearance between the plug and bore 386 and length of passageway 338, thereby adjusting resistance to flow of gas by a combination of cross-sectional flow area and length. A locking mechanism (not shown) is provided to fix the knob 396 and plug 384 at selected positions. The area of passageway 388 is continuously adjustable as the plug is moved to any selected position so that the cut-off speed of air motor 1 may be adjusted with improved resolution.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description as shown in the accompanying drawing shall be interpreted as illustrative and not in a limiting sense.

What is claimed is:

1. In an air motor of the expansible chamber type comprising an air cylinder, a piston reciprocable therein, a valve mechanism shiftable alternately to effect supply of air to and venting of air from opposite sides of the piston to reciprocate the piston, and a runaway control operable on increase in speed of the air motor above a speed limit to stop the motor, said control comprising a pressure-responsive mechanism comprising an air chamber for air under pressure, a movable mechanism movable away from a first position in response to increase in air pressure in said chamber above a predetermined pressure limit to a second position, and movable back to said first position on reduction of pressure in said chamber below said pressure limit, said movable mechanism when in its first position enabling operation of the air motor and when in its second position cutting off the operation of the motor, an air pump interconnected with the motor for operation simultaneously with the motor for delivering air under pressure to the chamber at a rate related to the speed of the motor, wherein the improvement comprises:

a bleed mechanism for bleeding air from the chamber at a controlled rate, the pressure in the chamber being controlled by the rate of delivery of air under pressure to the chamber and the bleed of air from the chamber, whereby on increase in speed of the motor above said speed limit, the pump, operating at increased speed, delivers air under pressure at an increased rate to said chamber over and above the capability of the bleed to bleed off the increase, and on ensuing increase in air pressure in the chamber above said pressure limit, said movable mechanism moves to its said second position to cut off the motor;

said bleed mechanism comprising a plurality of bleed flow paths of different lengths providing varying resistance to the flow of air, each bleed flow path having an inlet communicating with the chamber and an outlet, and a bleed path selector mechanism movable between a plurality of different settings corresponding to said plurality of different flow paths, said bleed path selector mechanism communicating in each of said settings with the outlet of one of said bleed flow paths and allowing said bleed flow path to vent for bleeding air from the chamber while sealing the outlets of the other bleed flow paths, whereby the speed limit at which motor cuts off can be adjusted by moving the selector mechanism to the desired setting.

2. The improvement to an air motor as set forth in claim 1 wherein said flow paths are connected in series.

3. The improvement to an air motor as set forth in claim 2 wherein said connected flow paths form a tortuous path, said outlets being at locations spaced along said tortuous path.

4. The improvement to an air motor as set forth in claim 1 wherein said bleed mechanism comprises a plate having channels therein forming said flow paths.

5. The improvement to an air motor as set forth in claim 1 wherein said channels are formed by one or more sinuous grooves formed in a face of said plate, said outlets being at locations along said one or more sinuous grooves.

6. The improvement to an air motor as set forth in claim 5 wherein said one or more sinuous grooves are formed by a single continuous groove having said outlets spaced at locations along the groove.

7. The improvement to an air motor as set forth in claim 5 wherein said bleed mechanism further comprises a gasket in sealing face-to-face engagement with said plate to close an open side of the grooving.

8. The improvement to an air motor as set forth in claim 1 wherein said bleed flow path selector mechanism comprises a plurality of valve members movable between closed positions in which they are seated in respective outlets to seal the outlets and open positions to permit airflow through the outlets, and a selector device for holding the valve members in their closed positions, said selector device being movable to select a desired setting corresponding to a specific speed limit and being configured such that when it is the selected setting, the valve member corresponding to said setting is adapted to open while the other valve members remain closed.

9. The improvement to an air motor as set forth in claim 8 wherein the selector device is rotatable.

10. A bleed system for venting pressurized gas from a chamber to a vent opening at a selectively adjustable flow rate to control change of pressure in the chamber, the bleed system comprising:

at least two passageways each adapted for venting gas from the chamber and thereby tending to reduce gas pressure in the chamber, each of said at least two passageways having a length; and a selector mechanism adapted for establishing fluid communication between the chamber and vent opening via a selected one of said passageways such that gas is vented from the chamber through the selected passageway to the vent opening;

said at least two passageways having different lengths such that selection of one passageway results in flow of gas from the chamber to the vent opening at one flow rate and selection of the other passageway results in flow of gas from the chamber to the vent opening at a different flow rate.

11. A bleed system as set forth in claim 10 wherein each passageway comprises a channel formed in a plate.

12. A bleed system as set forth in claim 11 wherein all passageways are formed in the same plate.

13. A bleed system as set forth in claim 12 wherein the passageways are connected in series.

14. A bleed system as set forth in claim 10 wherein each passageway has a generally uniform cross-sectional flow area along its entire length.

15. A bleed system as set forth in claim 14 wherein all passageways have substantially the same cross-sectional flow area.

16. A runaway motor control system for an air motor, the control system comprising:

a pressure-responsive mechanism operable on increase in speed of the air motor above a speed limit to stop the motor, said mechanism comprising an air chamber for air under pressure, a movable mechanism movable away from a first position in response to increase in air pressure in said chamber above a predetermined pressure limit to a second position, and movable back to said first position on reduction of pressure in said chamber below said pressure limit, said movable mechanism when in its first position enabling operation of the air motor and when in its second position cutting off the operation of the motor, an air pump interconnected with the motor for operation simultaneously with the motor for delivering air under pressure to the chamber at a rate related to the speed of the motor;

a bleed mechanism for bleeding air from the chamber at a controlled rate, the pressure in the chamber being controlled by the rate of delivery of air under pressure to the chamber and the bleed of air from the chamber, whereby on increase in speed of the motor above said speed limit, the pump, operating at increased speed, delivers air under pressure at an increased rate to said chamber over and above the capability of the bleed to bleed off the increase, and on ensuing increase in air pressure in the chamber above said pressure limit, said movable mechanism moves to its said second position to cut off the motor;

said bleed mechanism comprising a plate having a series of channels in a face thereof providing bleed flow paths of varying resistance to the flow of air.

17. A runaway motor control system as set forth in claim 16 wherein each bleed flow path has an inlet communicating with the chamber and an outlet, and further comprising a bleed path selector mechanism movable between a plurality of different settings corresponding to said plurality of different flow paths, said bleed path selector mechanism communicating in each of said settings with the outlet of one bleed flow path and allowing said bleed flow path to vent for bleeding air from the chamber while sealing the outlets of the other flow paths, whereby the speed limit at which motor cuts off can be adjusted by moving the selector mechanism to the desired setting.

18. A bleed system for venting pressurized gas from a chamber to a vent opening at a selectively adjustable flow rate to control change of pressure in the chamber, the bleed system comprising:

a passageway establishing fluid communication between the chamber and vent opening for venting gas from the chamber and thereby tending to reduce gas pressure in the chamber, the passageway having an inlet, an outlet, and a flow path extending between the inlet and the outlet;

an adjustment mechanism for selectively adjusting a length of the path to change a rate of flow of gas from the chamber to the vent opening.

19. A bleed system as set forth in claim 18 wherein the adjustment mechanism comprises a piston movable in a bore.

20. A bleed system as set forth in claim 19 wherein the passageway is defined by an annular gap between the piston and the bore.

21. A bleed system as set forth in claim 18 wherein the adjustment mechanism comprises a screw threaded in a bore.

22. A bleed system as set forth in claim 21 wherein the passageway is defined at least in part by a helical path along threads of the screw disposed in said bore.

* * * * *